US005258810A

United States Patent [19]

Bresina et al.

[11] Patent Number: 5,258,810

[45] Date of Patent: Nov. 2, 1993

[54] METHOD FOR CALIBRATING AN ELECTROPHOTOGRAPHIC PROOFING SYSTEM

[75] Inventors: Larry J. Bresina, St. Paul, Minn.; Gregory L. Zwadlo, Ellsworth, Wis.; Charles K. Nordeen, St. Paul, Minn.

[73] Assignee: Minnesota Mining and Manufacturing Company, St. Paul, Minn.

[21] Appl. No.: 807,076

[22] Filed: Dec. 13, 1991

[51] Int. Cl.[5] ..... G03G 15/01; G03G 15/00

[52] U.S. Cl. ..... 355/208; 355/214; 355/246; 355/327; 346/157

[58] Field of Search ..... 355/208, 214, 216, 246, 355/326, 327; 430/43, 45; 346/157; 358/80, 75

[56] References Cited

U.S. PATENT DOCUMENTS

| | | | |
|---|---|---|---|
| 2,956,487 | 10/1960 | Giaimo, Jr. | 355/261 |
| 3,612,753 | 10/1971 | Korman | 358/80 |
| 3,779,204 | 12/1973 | Altmann | 118/668 |
| 4,019,102 | 4/1977 | Wallot | 361/225 |
| 4,082,451 | 4/1978 | Patel | 355/71 |
| 4,179,213 | 12/1979 | Queener | 355/208 |
| 4,248,524 | 2/1981 | Takahashi | 355/214 |
| 4,262,071 | 4/1981 | Larson | 430/11 |
| 4,279,498 | 7/1981 | Eda et al. | 355/246 |

(List continued on next page.)

FOREIGN PATENT DOCUMENTS 48-90236 2/1972 Japan .

OTHER PUBLICATIONS

Research Disclosure dated Nov., 1989, pp. 821–827.

Electrophotographic Systems Solid Area Response Model, by K. Bradley Paxton, Eastman Kodak Company, Rochester, N.Y. 14650, Society of Photographic Scientists and Engineers, 1978, pp. 159–164.

Exposure Control in Laser Printing, by R. J. Straayer and R. E. Davis, Datapoint Corporation, 9725 Datapoint Drive, San Antonio, Tex. 78284, SPIE vol. 498 Laser Scanning and Recording 1984, pp. 83–89.

Principles of Color Proofing, Bruno, Gama Communications, 1986, Chapter VII.

*Primary Examiner*—Joan H. Pendegrass

*Attorney, Agent, or Firm*—Gary L. Griswold; Walter N. Kirn; Eric D. Levinson

[57] ABSTRACT

A calibration procedure for an electrophotographic proofing system of the type for generating color proofs during multiple image cycle proofing runs from imaging information representative of half-tone color patterns for each of a set of colors by sequentially, during the imaging cycle for each color of the set, charging a photoconductor as a function of a charge model representative of photoconductor contrast voltages as a function of a charging grid voltage, modulating a laser as a function of the color pattern information to expose the photoconductor, and toning the exposed photoconductor as a function of a development model representative of measured developed toner color densities as a function of development voltage. The calibration procedure generates charge and development models for each color of the set during one proofing run, and includes: i) charging a plurality of first color test patches on the photoconductor, each with a different known grid voltage from a range of grid voltages; ii) exposing the first color test patches on the photoconductor; iii) measuring the contrast voltages of the photoconductor at the first color test patches; iv) toning the first color test patches as a function of known development voltages; v) measuring the of the toner at the first color test patches; vi) repeating steps i–v for each remaining color of the set during one proofing run; vii) generating a charge model, for each color of the set, representative of the measured contrast voltages as a function of the associated grid voltages; and viii) generating a development model, for each color of set, representative of the measured toner densities as a function of the associated development voltages.

24 Claims, 6 Drawing Sheets

U.S. PATENT DOCUMENTS

| | | | |
|---|---|---|---|
| 4,312,589 | 1/1982 | Brannan et al. | 355/208 |
| 4,348,099 | 9/1982 | Fantozzi | 355/208 |
| 4,348,100 | 9/1982 | Snelling | 355/246 |
| 4,432,634 | 2/1984 | Tabuchi | 355/246 |
| 4,502,777 | 3/1985 | Okamoto et al. | 355/208 |
| 4,502,778 | 3/1985 | Dodge et al. | 355/206 |
| 4,519,695 | 5/1985 | Murai et al. | 355/246 |
| 4,564,287 | 1/1986 | Suzuki et al. | 355/208 |
| 4,587,536 | 5/1986 | Saito et al. | 346/160 |
| 4,647,184 | 3/1987 | Russell et al. | 355/208 |
| 4,693,593 | 9/1987 | Gerger | 355/208 |
| 4,708,459 | 11/1987 | Cowan et al. | 355/239 |
| 4,724,461 | 2/1988 | Rushing | 355/214 |
| 4,761,672 | 8/1988 | Parker et al. | 355/220 |
| 4,780,744 | 10/1988 | Porter et al. | 355/208 |
| 4,806,980 | 2/1989 | Jamzadeh et al. | 355/208 |
| 4,829,336 | 5/1989 | Champion et al. | 355/246 |
| 4,839,722 | 6/1989 | Barry et al. | 358/80 |
| 4,847,659 | 7/1989 | Resch, III | 355/202 |
| 4,853,738 | 8/1989 | Rushing | 355/327 |
| 4,860,059 | 8/1989 | Terashita | 355/38 |
| 4,860,924 | 8/1989 | Simms et al. | 222/56 |
| 4,878,082 | 10/1989 | Matsushita et al. | 355/208 |
| 4,879,577 | 11/1989 | Mabrouk et al. | 355/208 |
| 4,886,730 | 12/1989 | Ota et al. | 430/137 |
| 4,894,685 | 1/1990 | Shoji | 355/246 |
| 5,019,472 | 5/1991 | Beneck et al. | 430/43 |

REPLENISHMENT LOOKUP TABLE

| DEV. RATIO | PUMP STROKES | ml REPLENISHER |
|---|---|---|
| 0.00 | 0 | 0 |
| 0.80 | 0 | 0 |
| 0.85 | 1 | 0.5 |
| 0.90 | 2 | 1.0 |
| 0.95 | 3 | 1.5 |
| 1.00 | 3 | 1.5 |
| 1.05 | 4 | 2.0 |
| 1.10 | 5 | 2.5 |
| 1.15 | 6 | 3.0 |
| 1.20 | 7 | 3.5 |
| 1.25 | 8 | 4.0 |
| 1.30 | 8 | 4.0 |
| 1.35 | 8 | 4.0 |
| 1.40 | 8 | 4.0 |
| 1.45 | 8 | 4.0 |

METHOD FOR CALIBRATING AN ELECTROPHOTOGRAPHIC PROOFING SYSTEM

BACKGROUND OF THE INVENTION

The present invention relates generally to electrophotographic printing systems. In particular, the invention is a method for calibrating a full color electrophotographic proofing system.

Electrophotographic proofing systems are generally known and described, for example, in the Zwadlo et al. U.S. Pat. No. 4,728,983, Cowan et al. U.S. Pat. No. 4,708,459 and Porter et al U.S. Pat. No. 4,780,744. Systems of these types include a computer-based control system, and an organic photoconductor (OPC) which is sequentially driven past charging, exposing (imaging), developing and transfer stations during multiple imaging cycle (toning pass) proofing runs. A separate imaging cycle is performed for each component color used to create the image.

During each imaging cycle the OPC is first charged to an initial voltage by a charging device such as a scorotron at the charge station. The charged OPC is then exposed or imaged to produce a charge pattern representative of the image to be printed. Exposed portions of the OPC are discharged to a final voltage during this imaging operation. A bias voltage is applied to the development station to create a development voltage differential between the toning station and OPC. Charged toner is drawn to the imaged OPC as a function of the development voltage and OPC charge profile to develop or tone the imaged OPC as it passes the development station. This imaging cycle procedure is repeated for each component color to produce a composite image assembly in registration on the OPC. The proofing run is completed when the composite image assembly is transferred from the OPC to a backing by the transfer station.

The amount, and therefore density, of toner applied to the OPC at the developing station is controlled to impart desired color characteristics to the proof. Unfortunately, elements of the electrophotographic process described above have characteristics which change over time and produce uncontrollable variations in system dynamics. Two of the most serious process variables are changing charge characteristics of the OPC and changes in the dynamics of the developing system (both toner and mechanism).

The Cowan et al. and Porter et al. patents referenced above describe a half tone separation proofing system which includes compensation techniques for reducing toner density dependance on process variables. This compensation technique includes the use of four empirically derived mathematical models: a charger model, an exposure model, a decay model and a developer (toning) model. The charger model mathematically predicts the initial or unexposed voltage placed onto the OPC by the scorotron. The exposure model estimates the post-exposure OPC voltages on exposed test areas of the OPC. The decay model estimates the voltage decay experienced by the OPC as it travels to the developing station. The developer model estimates the density of the toned image given the development voltage. These models are used to predict actual system performance occurring during any toning pass and provide appropriate values of the controlled parameters (grid voltage, bias voltage and exposure setting) to maximize system performance during the next successive toning pass.

Actual measurement data is used to update the models at the conclusion of any toning pass. The cycle of performance prediction/parameter estimation followed by model updating is repeated for each successive toning pass.

The control process used in the Cowan et al. system executes two basic phases: calibration and toning. In operation, the calibration phase is run when required. During this phase, the system obtains OPC voltage measurements and estimates certain parameters indicative of the performance of the electrophotographic charging, exposure and decay processes that actually occur in the system. The calibration phase consists of only one pass during which no toning occurs. The result of the calibration phase is a set of parameter values for use during the subsequent toning phase. The calibration phase is run in specific instances before the toning phase begins in order for the system to establish a set of valid initial conditions.

Once the calibration phase, when used, is completed, the toning phase begins. During each successive toning pass, the system first predicts system performance and calculates the values of various controlled process parameters, by inverting the models using updated values from the previous pass or proof, in order to set the controlled process parameters (grid and bias voltages and exposure setting) correctly. Actual process data (toner densities, OPC voltages under conditions of varying exposure and at varying times) occurring during that pass are measured. These measurements are then used to update all the models for use during subsequent toning passes. The performance prediction/-parameter estimation and updating processes are again repeated during each successive toning pass.

There remains, however, a continuing need for improved density calibration and process control procedures for electrophotographic systems. The process control procedures must be capable of accurately compensating for process variables to repeatably produce proofs having desired color characteristics. The calibration procedure should facilitate the implementation of the process control procedures, and be capable of being efficiently performed. No operator interaction should be required to implement either the calibration or process control procedures. It would also be advantageous if these procedures could support a range of operator selected color characteristics.

SUMMARY OF THE INVENTION

The present invention is an improved method for generating the charge and development models used by an electrographic system for printing images from image information during a printing run. During an imaging cycle of the printing run a photoconductor is charged as a function of a charge model representative of a measured photoconductor charge characteristic as a function of a charge control parameter, exposed as a function of the image information, and toned as a function of a development model representative of a measured developed toner characteristic as a function of a development parameter. The calibration procedure quickly and efficiently generates the charge and development models during one printing run without any operator interation, and includes: i) charging a first color test patch on the photoconductor as a function of a known charge control parameter; ii) exposing the first color test patch on the photoconductor; iii) measuring the charge characteristic of the photoconductor at the first color test patch; iv) toning the photoconductor at the first color test patch with a first color toner as a function of a known development parameter; v) measuring the characteristic of the first color toner deposited on the first color test patch; vi) generating a charge model for the first color toner; and vii) generating a development model for the first color toner.

In other embodiments the electrographic system prints multicolored images from information representative of a set of half-tone color patterns by performing multiple imaging cycle printing runs, one imaging cycle for each color of the set. In this embodiment the calibration procedure also generates charge and development models for each color of the set during the printing run by: viii) charging a second color test patch on the photoconductor as a function of a known charge control parameter; ix) exposing the second color test patch on the photoconductor; x) measuring the charge characteristic of the photoconductor at the second color test patch; xi) toning the photoconductor at the second color test patch with a second color toner as a function of a known development parameter; xii) measuring the characteristic of the second color toner deposited on the second color test patch; xiii) repeating steps viii–xii for each color of the set during the printing run; xiv) generating a charge model for each color of the set; and xv) generating a development model for each color of the set.

In yet another embodiment the system generates charge and development models for a range of system characteristics. These models can be used to support a range of operator selectable color characteristics. In this embodiment the step of charging the photoconductor for each color of the set includes charging a plurality of test patches on the photoconductor with a range of different known charge control parameters. Measuring the charge characteristic for each color of the set includes measuring the charge characteristics of the photoconductor at each of the test patches. The test patches for each color of the set are toned with the toner as a function of known development parameters. The characteristics of the toner deposited on each of the test patches is measured. Charge models representative of measured charge characteristics as a function of the plurality of charge control parameters are generated for each color of the set. Development models representative of measured toner characteristics as a function of the associated development parameters are also generated for each color of the set.

In yet other embodiments, measuring the toner characteristic includes measuring toner thickness or optical density. The photoconductor is toned as a function of a development voltage. The development model includes information representative of the optical density as a function of the associated development voltage. The test patch is charged as a function of a known grid voltage, and the charge model includes information representative of measured charge characteristics as a function of associated grid voltage.

DETAILED DESCRIPTION OF THE PREFERRED EMBODIMENTS i. System Overview

Figure 1:
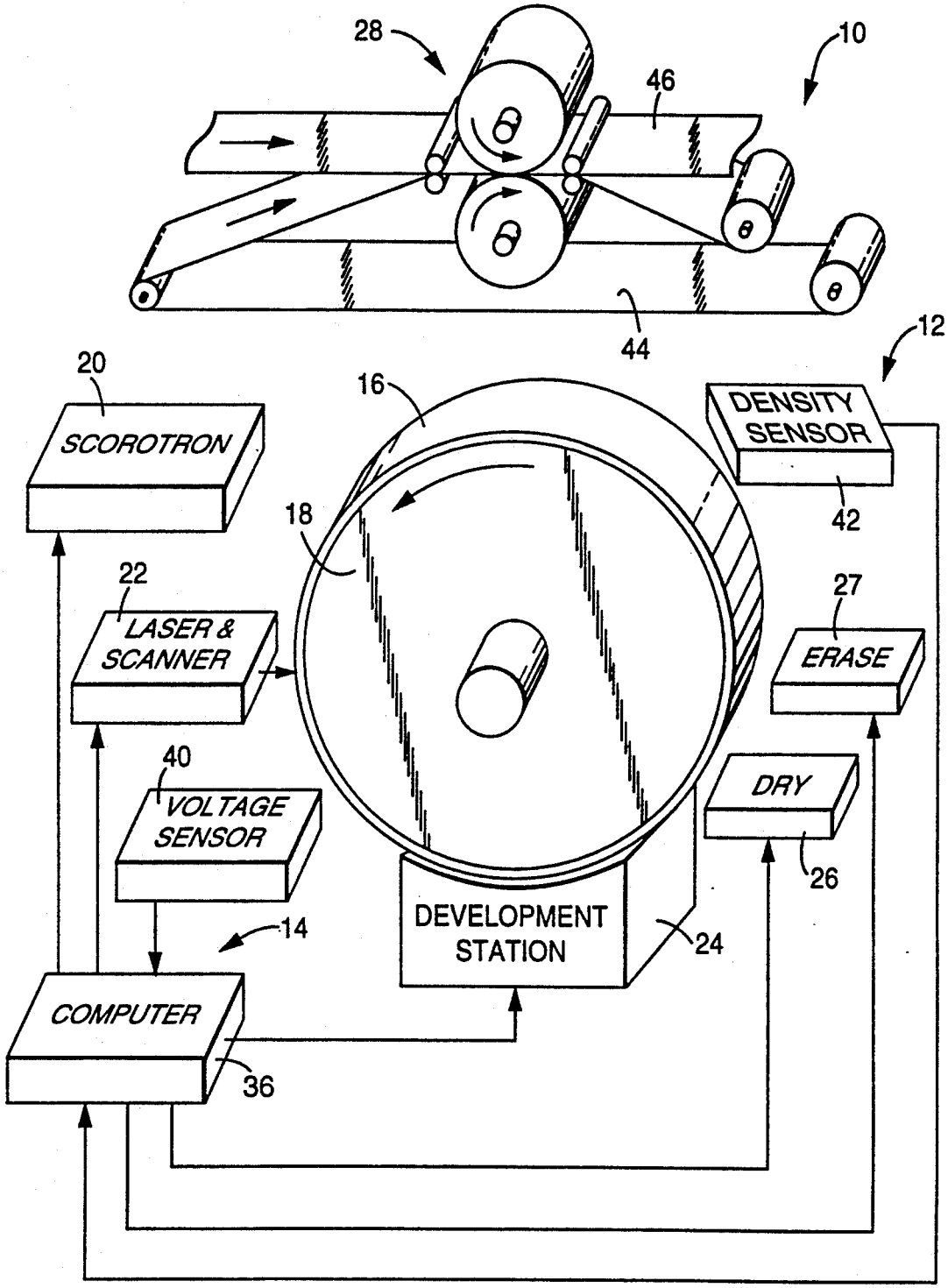
FIG. 1 is a block and pictorial diagram of an electrophotographic proofing system in which the density calibration procedure of the present invention can be implemented.
Figure 2A:
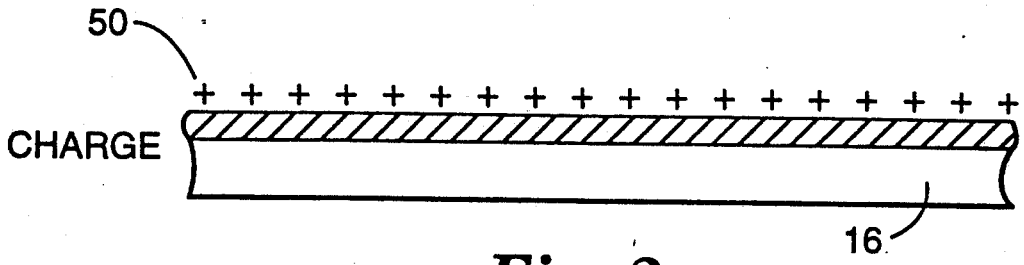
FIG. 2*a*–2*e* is a pictorial diagram illustrating the electrophotographic process implemented by the proofing system shown in FIG. 11.
Figure 2B:
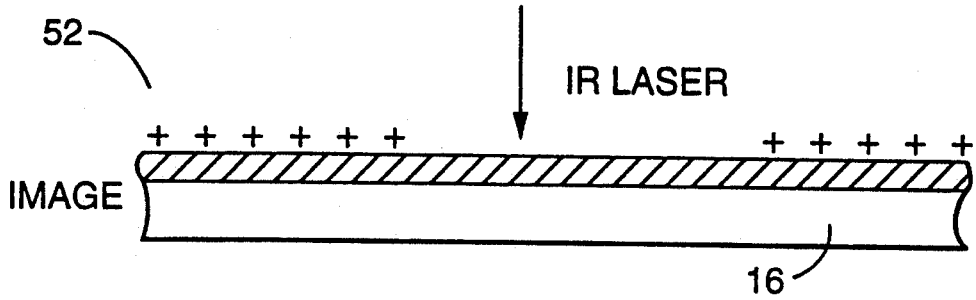
Figure 2C:
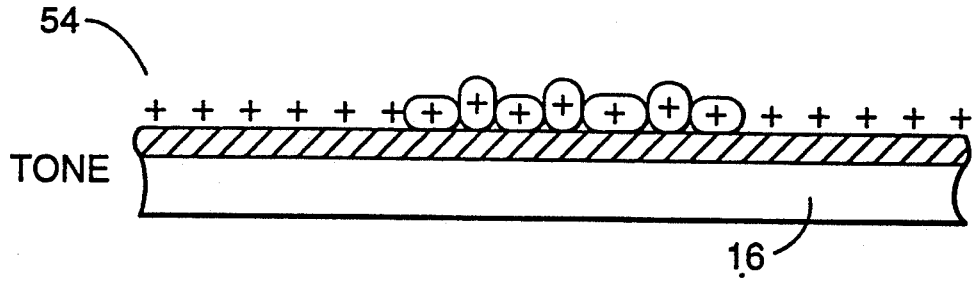
Figure 2D:
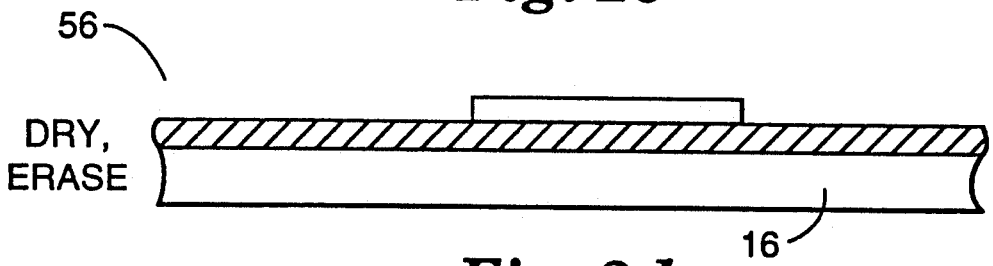
Figure 2E:
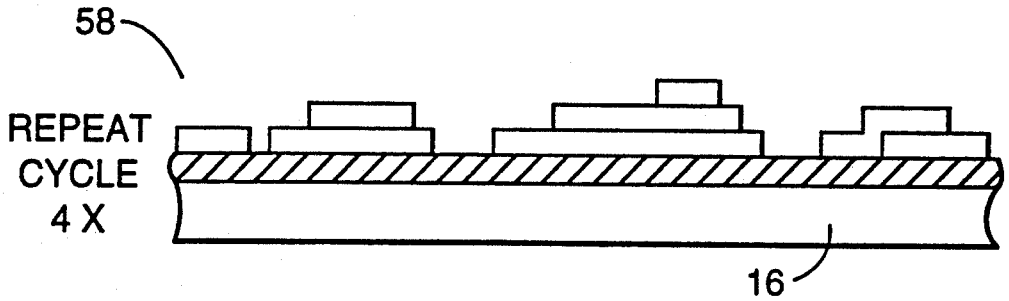

FIG. 1 is a diagrammatic illustration of a digital electrophotographic proofing system 10 which utilizes the density calibration procedures of the present invention. Proofing system 10 consistently prints hardcopy images or proofs from digital data representative of color half-tone patterns during multiple imaging cycle printing or proofing runs. The calibration procedure quickly and efficiently generates charge and development models which describe current system operating characteristics. The process control procedure uses the models, and measured proof and system characteristics from previous proofing runs, to control system response on a proof-to-proof basis and maintain proof quality over a wide range of fundamental process variables. These procedures require no operator interaction.

Proofing system 10 includes a proofing engine 12 controlled by a computer-based control system 14. In the embodiment shown, proofing engine 12 includes a film of organic photoconductor or OPC 16 on rotating drum 18, scorotron 20, laser and scanner 22, development station 24, dry station 26, erase station 27 and transfer station 28. In addition to computer 36, control system 14 includes voltage sensor 40 and density sensor 42.

Figures 7, 8:
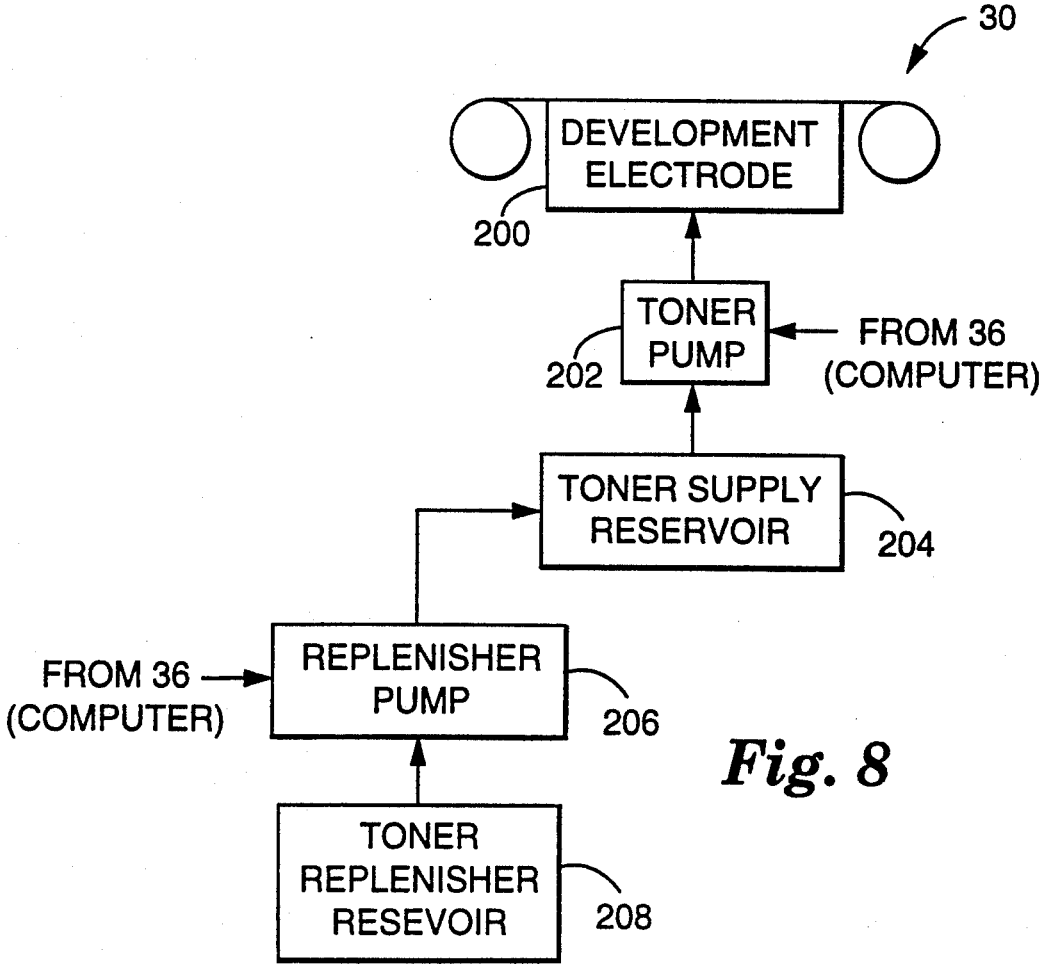
FIG. 7 is a graphic representation of a replenishment lookup table used by the density process control procedure.
FIG. 8 is a detailed block and pictorial diagram of a toning station included in the development station shown in FIG. 1.

Development station 24 includes four identical toning stations 30 such as that shown in FIG. 8 (only one station is illustrated), one for each of the primary component colors used to generate color proofs. Toning stations 30 include a development electrode 200, toner pump 202, toner supply reservoir 204, replenisher pump 206 and replenisher reservoir 208. Working toner is pumped from supply reservoir 204 to development electrode 200 by pump 202. As toner is depleted from supply reservoir 204 during the development process, the supply is replenished with replenisher toner pumped from replenisher reservoir 208 by pump 206.

The electrophotographic proofing process implemented by system 10 can be described generally with reference to FIGS. 1 and 2. Digital continuous tone, high resolution text, graphics, edge and contour data, and other image information representative of the image to be printed is stored within memory (not separately shown) of computer 36. From the image information computer 36 generates digital information representative of a set of binary or half-tone patterns, one pattern for each of the component colors used by system 10. In the embodiment described below, proofing system 10 uses black, cyan, magenta and yellow as the set of primary colors. Computer 36 therefore generates information representing black, cyan, magenta and yellow half-tone patterns for each proof to be printed.

Proofing engine 12 is driven through a proofing run to generate each proof. Each proofing run includes a sequence of imaging cycles, one for each component color, during which toner, in the half-tone patterns, is developed (toned) onto OPC 16 in registration with the others to produce a composite toned image assembly. The proofing run is completed and the hard copy proof produced when the composite image assembly is transferred to paper backing 46 by transfer station 28. In the embodiment shown, transfer station 28 implements a two step process. The composite assembly is first transferred from OPC 16 to a transparent adhesive transfer web 44. The composite image is then permanently applied to backing 46.

Component color compensation test patches are also imaged and developed during the proofing runs, typically near the edges of the printed images. Color characteristics such as optical densities of the test patches are measured from transfer web 44 during the image assembly transfer using transmission density sensor 42 in the embodiment shown. Alternatively, other characteristics such as lightness, chroma or hue of the developed toner can be measured and used to control system 10. The color characteristics of the test patches can also be measured at other points in the proofing run, such as from OPC 16 or backing 46.

The described embodiment of proofing system 10 implements a discharge area development (DAD) electrophotographic process. However, the inventive concepts disclosed herein can also be used in conjunction with other electrophotographic and electrographic processes. Drum 18 is rotated during the imaging cycles to sequentially drive portions of OPC 16 past scorotron 20, laser and scanner 22, developing station 24, dry station 26 and erase station 27. Each imaging cycle begins with the application of a grid voltage, $V_g$, to scorotron 20. The grid voltage is a charge control parameter which causes scorotron 20 to charge the surface of OPC 16 to a charged or initial voltage, Vi, as shown at 50 in FIG. 2. As shown at 52, the charged OPC 16 is then exposed or imaged by a scanning laser beam as the OPC rotates past laser and scanner 22. The laser beam is on-off modulated as a function of the component color half-tone pattern to partially discharge the portions of OPC 16 upon which it is impinged, resulting in a discharged or final voltage, Vf, on the OPC. As the imaged OPC 16 reaches developing station 24, a developer bias voltage, Vb, is applied to the appropriate development electrode 200 to produce a development voltage contrast or development voltage, $V_d$, between the OPC and toning station. The toner, which is charged, is thereby drawn to the imaged OPC 16 in accordance with the half-tone pattern and test patches as shown at 54. Toner from the appropriate reservoir 208 is pumped into the associated supply reservoir 204 to replenish toner consumed during the toning operation. With continued rotation of drum 18 the toned or developed OPC 16 passes dry station 26 and erase station 27 as indicated at 56 in FIG. 2. The liquid toner is dried at station 26. Remaining charge on OPC 16 is dissipated at erase station 27. This imaging cycle procedure is repeated for each component color and its associated half-tone pattern to produce the developed image assembly shown at 58. The proofing run is completed when the developed image assembly is removed from OPC 16 and applied to backing 46 by transfer station 28.

Density process control is accomplished using three control variables: 1) the grid voltage, $V_g$; 2) the development voltage, $V_d$; and 3) the amount of replenishment toner added. The grid voltage is used as a control parameter to control background voltage contrast (the difference between the initial OPC voltage and the bias voltage) and minimize toner density variation. The development voltage is used to control the color characteristics of the solid primary colors through relatively short term (e.g., proof-to-proof) control over the development system. Long-term control over the development system is achieved through the use of toner replenisher as the control variable to minimize variations in development voltage and dot gain.

The density calibration, also known as the development voltage ramp test, is periodically executed by proofing system 10 to generate system charge and development models. These models are used in the density process control procedure during proofing runs to determine the initial setpoint values and subsequent adjustments to the grid and development voltages. The detailed description of the calibration and density process control procedures implemented by system 10 uses the parameters defined in Table 1 below. In general, the convention used throughout the remainder of this description uses the subscript "t−1" to refer to the parameters measured during the most recently executed (i.e., previous) imaging cycle. The subscript "t" is used to refer to computed parameters used to control the electrophotographic process during the next or subsequent image cycle for the same component color. It is to be understood, however, that the subscript "t" parameters can be computed during the previous imaging cycle and stored in memory once the needed parameters have been measured.

| | |
|---|---|
| Vi | Measured initial OPC voltage, or initial voltage |
| Vf | Measured final OPC voltage, or final voltage |
| Vb | Developer bias voltage, or developer bias |
| Vg | Scorotron voltage, or grid voltage |
| $(Vi\text{-}Vb)_T$ | Target background voltage contrast, or background voltage |
| $V_d$ = Vb-Vf | Development voltage contrast, or development voltage |
| $V_c$ = Vi-Vf | Total OPC voltage contrast, or OPC voltage contrast |
| D | Optical density, reflection or transmission |
| $V_d^o$ | Development voltage contrast computed from the most recent density calibration and uncorrected for process drift |
| $V_d^o$(fresh) | Development voltage contrast computed from a density calibration using fresh working toner |
| $D_{Target}$-$D_{(t-1)}$ | Process induced density drift which must be corrected for on the next proof |
| $\Delta V_{d(t)}$ | Development voltage correction for process drift to be used for the next proof |
| $V_{d(t)}$ | Development voltage to be used for the next proof |
| $\Delta V_{d(t-1)}$ | Development voltage correction for process drift used for the previous proof |
| J | Slope of the development model at $V_d^o$ |
| $V_c^o$ | Target total OPC voltage contrast |

-continued

| | |
|---|---|
| | computed from the most recent density calibration and uncorrected for process drift |
| $\Delta V_{c(t)}$ | Voltage contrast process drift which must be corrected for on the next proof |
| H | Slope of the charge model at $V_g^o$ |
| $V_g^o$ | Scorotron grid voltage computed from the most recent density calibration and uncorrected for process drift |
| $\Delta V_{g(t)}$ | Scorotron grid voltage correction for process drift to be used for the next proof |
| $V_{g(t)}$ | Scorotron grid voltage to be used for the next proof |
| $\Delta V_{g(t-1)}$ | Grid voltage correction for process drift used for the previous proof |
| $\partial$ | Density difference threshold for development voltage correction |
| $\eta$ | Voltage contrast threshold for grid voltage correction |

II. Density Calibration Procedure

Figure 3:
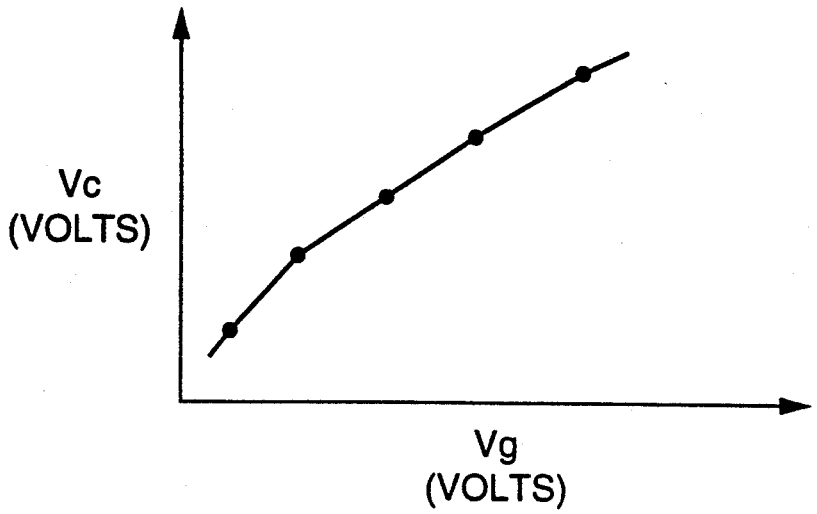
FIG. 3 is a graphic representation of a charge model generated by the calibration procedure of the present invention.

Charge models are information stored in computer 36 which characterize the relationship between a range of grid voltages Vg applied to scorotron 20 and the resulting measured OPC voltage contrasts $V_c$, The OPC voltage contrast is a parameter which describes the actual measured charge characteristics of OPC 16. For each grid voltage, the associated OPC voltage contrast is determined by computer 36 from the initial voltage Vi and the final voltage Vf measured by sensor 40 after portions of the OPC have been imaged by laser and scanner 22. FIG. 3 is a graphic representation of an OPC charge model. A separate charge model is generated and stored for each component color.

Figure 4:
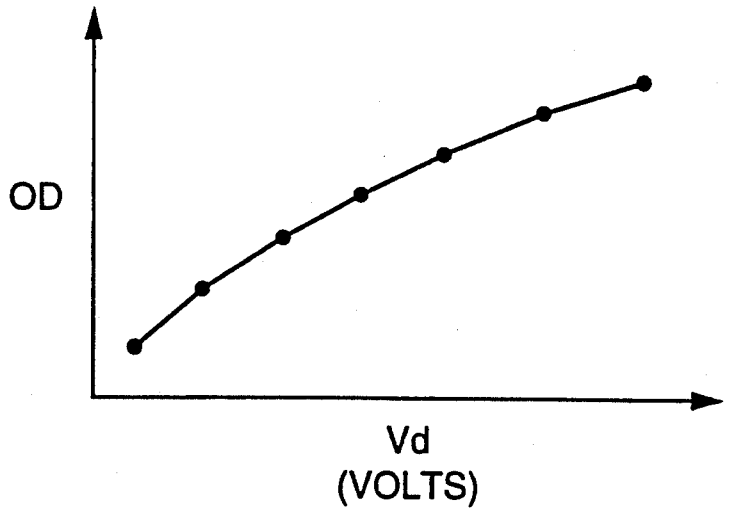
FIG. 4 is a graphic representation of a development model generated by the calibration procedure of the present invention.

Development models are information stored in computer 36 which characterize the relationship between a range of development voltages applied to toning stations 30 and the resulting measured optical density, D, of toner transferred to OPC 16. The optical density is a parameter which describes the actual measured color characteristics of the toned image. FIG. 4 is a graphic representation of a development model. A separate development model is generated and stored for each component color.

Figure 5:
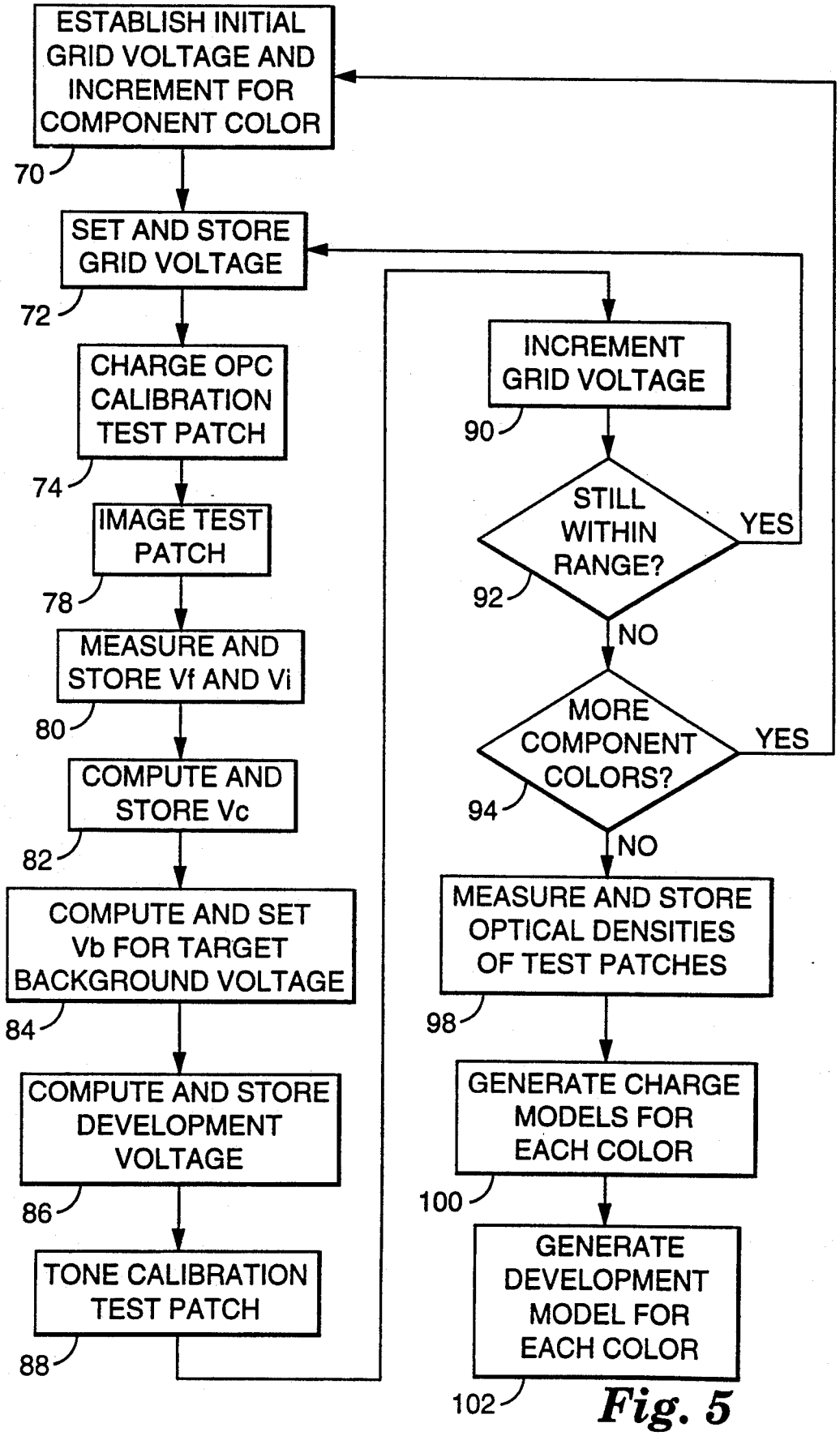
FIG. 5 is a flowchart describing the calibration procedure of the present invention.

The density calibration procedure used by proofing system 10 is described generally in FIG. 5. The calibration procedure is performed during a calibration proofing run which is periodically executed, as for example, when working toner in development station 24 and/or OPC 16 are changed. As shown in FIG. 5, the calibration procedure is used to generate and store the charge and development models for each of the component colors used by proofing system 10.

Computer 36 begins the density calibration procedure by establishing an initial grid voltage for the first component color, as well as the increment between the discrete grid voltages used during calibration. This step is shown at 70 in FIG. 5, and effectively determines the range of grid voltages over which the response of system 10 will be measured. The selected range of grid voltages must be large enough to include all the expected operating points of system 10. In one embodiment the initial grid voltage and voltage increment to be used after the toner in the supply reservoir 204 of station 30 is replaced, and/or after the installation of a new OPC 16, are determined through laboratory experimentation and programmed into computer 36. The initial grid voltage and increment can also vary with different toners and OPCs 16. The initial grid voltage for subsequent calibration procedures can be set to the grid voltage used during the most recently run imaging cycle less some predetermined value. These and other operator specified parameters can be programmed into computer 36 through a terminal (not separately shown).

Once the range information has been established, computer 36 causes the initial grid voltage to be applied to grid 20. A first calibration test patch on OPC 16 is charged accordingly, and rotated toward laser and scanner 22. These actions are indicated by steps 72 and 74. The first test patch is then imaged by laser and scanner 22, and the initial and final voltages on the test patch (and adjacent unimaged areas for Vi) are measured by sensor 40. The voltage contrast associated with the initial grid voltage can then be computed and stored by computer 36. These actions are indicated by steps 78, 80 and 82 in FIG. 5.

During calibration proofing runs, computer 36 sets the bias voltage to maintain a predetermined and stored target background voltage contrast. The bias voltage is therefore computed by subtracting the target background voltage contrast from the initial voltage in accordance with Eq. 1. Alternatively, the background voltage can be set as a function of the development voltage (e.g., a fraction of the development voltage). As this bias voltage is applied to the appropriate toning station 30 to develop the first test patch, the associated development voltage is computed and stored by computer 36. These actions are indicated by steps 84, 86 and 88 in FIG. 5.

$$Vb = Vi - (Vi - Vb)_T \qquad \text{Eq. 1}$$

After charging the first test patch associated with the initial grid voltage, the grid voltage is increased by the increment value as indicated at 90. Steps 72–90 are then repeated with the second grid voltage and associated second test patch. Steps 72–90 are also repeated with third and subsequent grid voltages and associated test patches until the desired range of grid voltages has been covered as indicated at 92. This process can be performed during one imaging cycle for the component color.

As shown at 94, steps 70–92 are also repeated for each remaining component color during subsequent imaging cycles of the proofing run to produce a developed test patch image assembly. The optical density of the test patches is measured by sensor 42 and stored in computer 36 (step 98) after the test patch image assembly is transferred to web 44. This action completes the calibration proofing run and results in two sets of stored information for each of the component colors. The first set is a series of scorotron voltages and corresponding OPC voltage contrasts. The second set is a series of associated development voltages and corresponding printed optical densities.

Computer 36 uses the sets of calibration information described above to generate the charge and development models for each component color. These steps are illustrated generally at 100 and 102 in FIG. 5. In one embodiment the models are stored as parameters of quadratic Equations 2 and 3, below, fit to the sets of data using an ordinary least squares approach. In other embodiments, the development system model can be fit as a linear relationship. Alternatively, the models can be stored as lookup tables.

| | | |
|---|---|---|
| Charge System Model | $V_c = AVg^2 + BVg + C$ | Eq. 2 |
| Development System Model | $OD = EV_d^2 + FV_d + G$ | Eq. 3 |

III. Density Control Procedure

Figure 6:
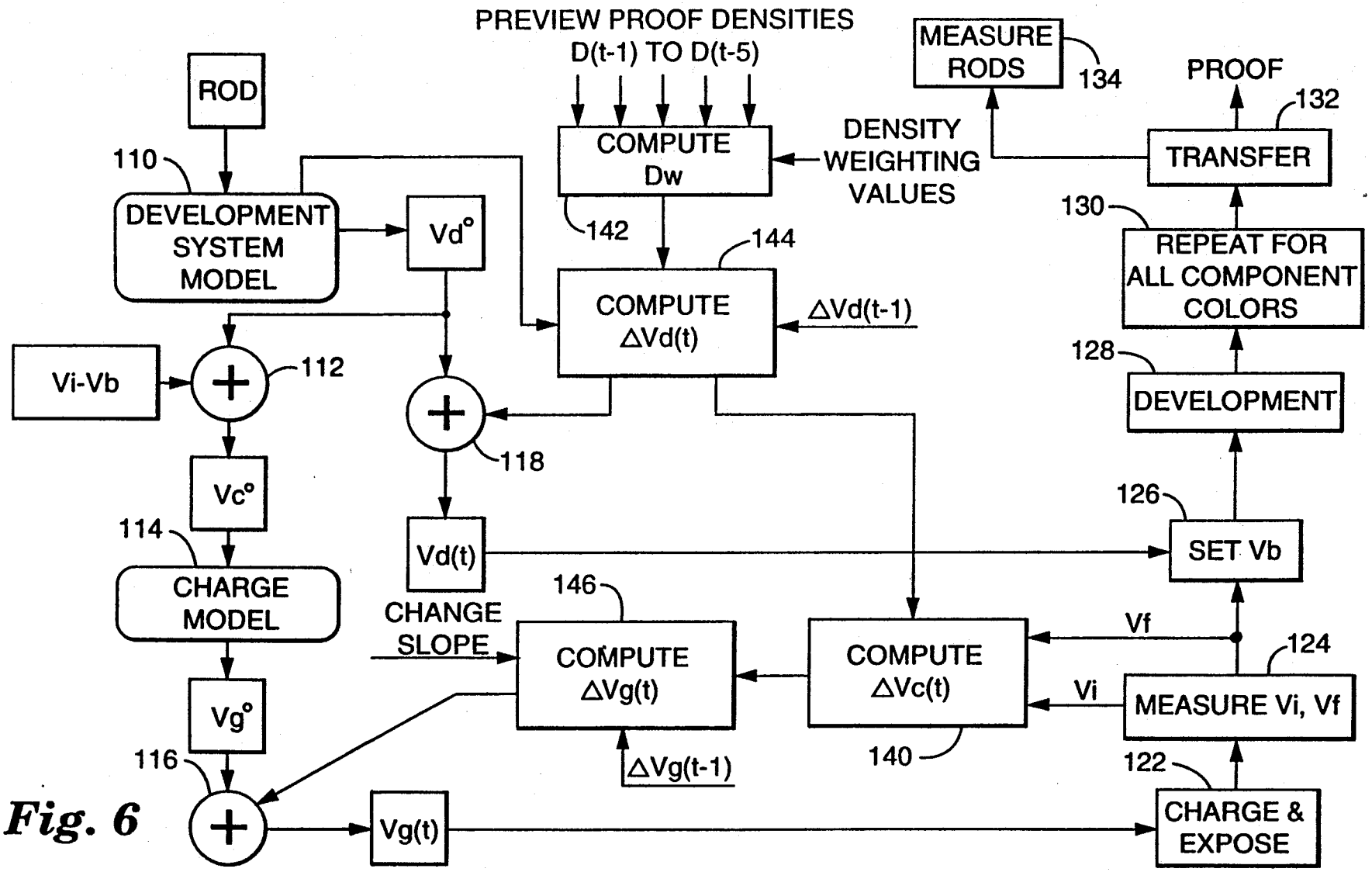
FIG. 6 is a flowchart describing a density process control procedure which uses the charge and development models generated by the calibration procedure.

The density process control procedure implemented by proofing system 10 is illustrated generally in FIG. 6. This procedure uses measured system and print characteristics (voltage contrast and density values) from previous imaging runs to access the stored charge and development models in an attempt to determine process parameters (grid and development voltages) for subsequent imaging runs to produce proofs having a desired or target optical density. The charge and development models are effectively continually updated to accurately reflect then-current operating characteristics of proofing system 10.

A. Prediction Of Process Parameters For The First Proof After A Density Calibration The first imaging cycle for each component color after a density calibration run begins with the calculation of the initial development voltage $V_d^o$. This is done by accessing or solving the development system model (e.g., Eq. 3) as a function of the target density, as shown by step 110 in FIG. 6. The target density is selected by an operator from within the range supported by the models. Once the initial development voltage has been determined, the target initial OPC voltage contrast is computed in accordance with Eq. 4 below (step 112). The charge model is accessed or solved (e.g., Eq. 2) using the initial OPC voltage contrast to determine the initial grid voltage $V_g^o$ for the imaging cycle (step 114).

$$V_c^o = (Vi - Vb)_T + V_d^o \qquad \text{Eq. 4}$$

No compensation for process drift is performed during the first imaging cycle after a calibration proofing run (i.e., there was no "previous" proofing run or imaging cycle). Accordingly, parameters associated with this compensation and described below, e.g., $\Delta V_{d(t)}$, and $\Delta Vg_{(t)}$, are all set equal to zero for the first imaging run for each component color (i.e., during the first proofing run). The grid voltage $Vg_{(t)}$ used to charge OPC 16 is therefore set equal to the initial grid voltage $V_g^o$ during calculation step 116. Similarly, the development voltage $V_{d(t)}$ used to compute the developer bias voltage is set equal to the initial development voltage $V_d^o$ during calculation step 118. After the actual initial and final voltages are measured (step 124), the bias voltage $Vb_{(t)}$ to be applied to the toning station 30 to achieve the proper development voltage is computed in accordance with Eq. 5 below and applied to the appropriate toning station 30. This step is indicated at 126. Alternatively, Vb can be determined as a function of Vi and Vf.

$$Vb_{(t)} = Vf_{(t)} + V_{d(t)} \qquad \text{Eq. 5}$$

As these parameters of the electrophotographic process are being determined, proofing system 10 is driven through the imaging cycle for the first component color. OPC 16 is charged through the application of the grid voltage to grid 20, and imaged by laser and scanner 22 as a function of the stored half-tone pattern image information (step 122). The initial and final voltages on OPC 16 are measured (step 124) for use as feedback parameters during subsequent imaging runs and for computing the bias voltage (Eq. 5). As indicated at 126 and 128, the imaged OPC 16 is developed by applying the computed bias voltage to the appropriate toning station 30. These steps are repeated for each component color during subsequent imaging cycles of the first proofing run as indicated at 130. The composite image is then removed from OPC 16 by transfer station 28 and applied to backing 46 to complete the proofing process.

During each imaging cycle of the proofing run at least one compensation test patch for the associated component color is also imaged and developed. The compensation test patches are typically located near the edge of the image being printed. The actual densities of the component colors are measured from the compensation test patches by sensor 42 (step 134) during the transfer process, and used as feedback parameters during subsequent proofing runs.

B. Compensation For Development System Fluctuations From Proof To Proof

The development voltage contrast required to obtain a desired developed toner density can vary on a relatively short-term basis because of unpredictable fluctuations in the characteristics of the development system. To compensate for these fluctuations, the calibration procedure of the present invention generates a development voltage correction $\Delta V_{d(t)}$ which is added to the initial development voltage during the imaging runs of the second and all subsequent proofing runs in an attempt to minimize the difference between the expected (i.e., operator selected target) and actual toner densities during the imaging cycle.

The development voltage correction is determined as a function of the difference between the desired or target density and the actual measured density of the compensation test patches on one or more previous proofs. In the embodiment shown in FIG. 6, the measured density value used for this difference computation is a weighted density average, $D_w$, of the measured densities from up to five previous proofs, i.e., $D_{(t-1)}$ to $D_{(t-5)}$. The step of calculating the weighted density average is indicated at 142 in FIG. 6. Computer 36 stores the density weighing coefficients $C_1$–$C_6$, and computes the weighted density average in accordance with Eq. 6. In other embodiments, the density average is an average of measured densities from several spaced test patches on the immediately proceeding proof.

$$D_w = [C_1 D_{(t-1)} + C_2 D_{(t-2)} + C_3 D_{(t-3)} + C_4 D_{(t-4)} + C_5 D_{(t-5)}]/C_6 \qquad \text{Eq. 6}$$

The difference between the target and measured density values is compared to the density difference threshold $\partial$ to determine if a change should be made to the development voltage. This determination and the appropriate calculations are indicated at 144 in FIG. 6, and are made by computer 36 in accordance with Eqs. 7–9 below.

$$\text{If: } |D_{Target} - D_w| < \partial \qquad \text{Eq. 7}$$
$$\text{Then: } \Delta V_{d(t)} = 0$$
$$\text{If: } |D_{Target} - D_w| \geqq \partial \qquad \text{Eq. 8}$$
$$\text{Then: } \Delta V_{d(t)} = \Delta V_{d(t-1)} + (1/J)(D_{Target} - D_w)$$
$$\text{Where: } J = 2AV_d^0 + B \qquad \text{Eq. 9}$$

The value J is the slope of the development system model at the initially determined development voltage.

From Eqs. 8 and 9 it is evident that the development voltage correction is a value which uses the development model to approximate density-caused changes to the development voltage assuming linear behavior near the operating point.

As indicated at 118, the development voltage used for the second and subsequent proofs following a calibration run is computed in accordance with Eq. 10. Sensitivity of the development voltage to the development voltage correction is reduced by the factor K, which can be a value such as 2. Although not shown in Eq. 10, the maximum development voltage correction added during any given imaging cycle can also be limited to a percentage of the previous development voltage, such as 4%. This development voltage compensation procedure is repeated during each imaging cycle using the models and measured values for the corresponding component color.

$$V_{d(t)} = V_d^o + (\Delta V_{d(t)})/K \qquad \text{Eq. 10}$$

C. Compensation For OPC Fluctuations From Proof To Proof

The density calibration procedure of the present invention also compensates for fluctuations in the charging, sensitivity and dark decay characteristics of OPC 16. These charge compensation procedures are made by computing a grid voltage correction $\Delta Vg_{(t)}$ which is added to the initial grid voltage during the second and all subsequent proofs in an attempt to minimize the difference between the expected and actual total voltage contrast imparted to OPC 16.

The grid voltage correction is determined as a function of the initial and final voltages measured from OPC 16 during the imaging run for the corresponding color on the immediately preceding proofing run (step 124 in FIG. 6) as well as the target voltage contrast, $Vc_{(t-1)target}$, for that imaging run. From the measured initial and final voltages the actual OPC voltage contrast $Vc_{(t-1)actual}$ can be determined by computer 36 using Eq. 11. The target voltage contrast is computed from the development voltage used for the corresponding color during the previous proofing run and the target background voltage contrast in accordance with Eq. 12. The voltage contrast error $\Delta Vc_{(t)}$ is then computed as the difference between the target OPC voltage contrast and the actual OPC voltage contrast in accordance with Eq. 13. Step 140 in FIG. 6 represents the calculations of Equations 11-13.

$$Vc_{(t-1)actual} = Vi_{(t-1)} - Vf_{(t-1)} \qquad \text{Eq. 11}$$

$$Vc_{(t-1)target} = (Vi - Vb)_T + Vd_{(t-1)} \qquad \text{Eq. 12}$$

$$\Delta Vc_{(t)} = Vc_{(t-1)target} - Vc_{(t-1)actual} \qquad \text{Eq. 13}$$

The voltage contrast adjustment to be made for the next proof is compared to the voltage contrast threshold $\hbar$ to determine if a change should be made to the grid voltage. This determination and the appropriate calculations are indicated at 146 in FIG. 6, and made by computer 36 in accordance with Eqs. 14-16 below $$\text{If: } |\Delta Vc_{(t)} + \Delta V_{d(t)} - \Delta V_{d(t-1)}| < h \qquad \text{Eq. 14}$$
$$\text{Then: } \Delta Vg_{(t)} = 0$$
$$\text{If; } |\Delta Vc_{(t)}| \geqq \hbar \qquad \text{Eq. 15}$$
$$\text{Then: } \Delta Vg_{(t)} = \Delta Vg_{(t-1)} + (1/H)(\Delta Vc_{(t)} + \Delta V_{d(t)} - \Delta V_{d(t-1)})$$

-continued $$\text{Where: } H = 2AVg^0 + B \qquad \text{Eq. 16}$$

The value of H is the slope of the charge model at the initial grid voltage $Vg^o$. The grid voltage correction is a value which uses the charge model to approximate voltage contrast-caused changes to the grid voltage assuming linear behavior in the region near the operating point.

Once the grid voltage correction has been calculated, it is added to the initial grid voltage by computer 36 in accordance with Eq. 17 (step 116) to determine the grid voltage to be used for the next imaging cycle. Sensitivity of the grid voltage to the grid voltage correction is reduced by the factor L, which can be a value such as 2. Although not shown in Eq. 17, the maximum grid voltage correction added during any given imaging cycle can also be limited to a predetermined maximum such as a percentage of the previous grid voltage for the same component color.

$$Vg_{(t)} = Vg^0 + \Delta Vg_{(t)}/L \qquad \text{Eq. 17}$$

The procedure described above is repeated for each component color imaging cycle for each proof following a calibration procedure.

D. Toner Replenishment Control

Computer 36 also causes toner replenisher to be added to supply reservoirs 204 of toning station 30 (FIG. 8) after each proofing run as a function of the development voltages. Tone replenishment in this manner minimizes development voltage drift as the toner is depleted during the development process. The amount of toner replenisher to be added for each component color is determined by first computing the ratio of development voltage for the next proof (computed in the manner described above in section B), to the fresh toner development voltage computed after a density calibration with fresh working toner, i.e., $V_{d(t)}/V_d^o$. The toner replenisher is added to the appropriate supply reservoir 204 by actuating the associated pump 206 as a function of the computed ratio before the next proofing run.

In one embodiment of system 10, computer 36 includes a replenishment lookup table of data characterizing development voltage ratios and associated pump strokes for each component color. The number of pump strokes determines the amount of toner replenisher that will be added. A representation of one such replenishment lookup table, with replenisher volume illustrated for reference only, is illustrated in FIG. 7. Computer 36 accesses the appropriate replenishment lookup table as a function of the development voltage ratio to determine the proper number of pump strokes, and actuates the corresponding pump 206 accordingly for each component color.

The toner replenisher added to replenishment reservoir 208, like the fresh toner initially used in supply reservoirs 204, includes a colorant, binder and charge control agent in a carrier. To minimize the changes to the properties of toner in reservoirs 204 as replenisher is added, the toner replenisher is formulated with a lesser amount of charge control agent than the fresh toner. This formulation minimizes charge carrier buildup in the replenished toner in reservoir 204, thereby reducing changes which would otherwise have to be made to the development voltage to maintain image quality.

The black, magenta and cyan toner composition and processing examples described below represent the best fresh or working toners contemplated for use in proofing system 10. These compositions can also be optimized for particular proofing systems 10 by blending different lots of mill bases to obtain an intermediate value of the charge level in the toner. These and other toner examples are disclosed in commonly assigned copending application Ser. No. 07/652,572 filed Feb. 8, 1991 and entitled Liquid Electrophotographic Toner.

The following samples were milled on an Igarashi mill. Black was milled for 1 hour at 1000 rpm, cyan and magenta were milled for 90 minutes at 2000 rpm. After milling the toner was diluted; black diluted to 0.5% solids, magenta and cyan to 0.4% solids.

EXAMPLE 1

| Mill base | Components |
|---|---|
| Black 1 | Mix together first: |
| | 49.15 grams Zr Ten Cem (40% solids - solvent is VMP naptha) |
| | 1.23 grams Na Stearate |
| | Then add: |
| | 76.8 grams Regal 300 carbon black |
| | 1956.69 grams organosol (15.7% solids - solvent is Isopar TM G) |
| | 153.6 grams Foral TM 85 |
| | 1012.91 grams Isopar TM G |
| Magenta 1 | Mix together first: |
| | 21.10 grams Zr Ten Cem (40% solids - solvent is VMP naptha) |
| | 0.53 grams Na Stearate |
| | Then add: |
| | 36.13 grams Sun Red pigment 234-0077 |
| | 856.30 grams organosol (15.7% solids - solvent is Isopar TM G) |
| | 507.57 grams Isopar TM G |

EXAMPLE 2

| Mill base | Components |
|---|---|
| Magenta 2 | Mix Together: |
| | 1.90 grams Zr Ten Cem (40% solids - solvent is VMP natha) |
| | 0.10 grams Sodium Stearate |
| | Then add: |
| | 3.74 grams Sun Red pigment 234-0077 |
| | 2.50 grams Quindo Magenta pigment |
| | 162.08 grams organosol (15.7% solids - solvent is Isopar TM G) |
| | 89.69 grams Isopar TM G |

EXAMPLE 3

| Mill base | Components |
|---|---|
| Cyan 1 | Mix together: |
| | 44.6 grams Zr Ten Cem (40% solids - solvent is VMP naptha) |
| | 0.28 grams Sodium Stearate |
| | Then add: |
| | 68.37 grams G. S. Cyan (Sun Chemical) |
| | 1.3 grams carbon black pigment |
| | 2262.53 grams organosol (15.4% solids - solvent is Isopar TM G) |
| | 1512.13 grams Isopar TM G |

For these prepared toner compositions, the best toner replenisher compositions have similar proportions (as compared to the fresh toner) of all components except for the metal soap. The concentration allowed for the metal soap in the toner replenisher (concentrate less metal soap) varies with the particular metal soap used. For the two preferred metal soaps, Zr and Na, the concentration of metal soap in the replenisher can be 30–80% by total weight of the concentration in the initial (starter) toner for Zr soap, and 40–100% of total weight of the concentration in the initial (starter) toner for the Na soap. For purposes of this percentage calculation, the replenisher is the weight of concentrate without the metal soap being included.

Although the present invention has been described with reference to preferred embodiments, those skilled in the art will recognize that changes may be made in form and detail without departing from the spirit and scope of the invention.

What is claimed is:

1. In an electrophotographic system for printing an image from image information during a printing run including an imaging cycle by charging a photoconductor during the imaging cycle as a function of a charge model representative of a measured photoconductor charge characteristic as a function of a charge control parameter, exposing the photoconductor as a function of the image information during the imaging cycle, and toning the exposed photoconductor during the imaging cycle as a function of a development model representative of a measured developed toner characteristic as a function of a development parameter; the improvement comprising a calibration procedure for generating the charge and development models during one system printing run, including;

i) charging a first color test patch on the photoconductor as a function of a known charge control parameter;

ii) exposing the first color test patch on the photoconductor;

iii) measuring a charge characteristic of the photoconductor at the first color test patch;

iv) toning the photoconductor at the first color test patch with a first color toner as a function of a known development parameter;

v) measuring the characteristic of the first color toner deposited on the first color test patch;

vi) generating a charge model for the photoconductor; and vii) generating a development model for the first color toner;

wherein the calibration procedure generates both charge and development models during one system printing run.

2. The invention of claim 1 wherein the electrophotographic system prints multicolored images from information representative of a set of half-tone color patterns during multiple imaging cycle printing runs by sequentially, during an imaging cycle for each color of the set, charging, exposing and toning the photoconductor, and the calibration procedure further includes generating charge and development models for each color of the set during the printing run by:

viii) charging a second color test patch on the photoconductor as a function of a known charge control parameter;

ix) exposing the second color test patch on the photoconductor;

measuring the charge characteristic of the photoconductor at the second color test patch;

xi) toning the photoconductor at the second color test patch with a second color toner as a function of a known development parameter;

xii) measuring the characteristic of the second color toner deposited on the second color test patch;

xiii) repeating steps viii–xii for each remaining color of the set during the printing run;

xiv) generating a photoconductor charge model for each color of the set; and xv) generating a development model for each color of the set.

3. The invention of claim 2, wherein: charging the photoconductor for each color of the set includes charging a plurality of test patches on the photoconductor with a range of different known charge control parameters;

measuring the charge characteristic for each color of the set includes measuring the charge characteristic of the photoconductor at each of the test patches;

toning the test patch for each color of the set includes toning each of the test patches with the toner as a function of known development parameters;

measuring the toner characteristic for each color of the set includes measuring the characteristic of the toner deposited on each of the test patches;

generating the photoconductor charge model for each color of the set includes generating a charge model representative of measured charge characteristics as a function of the associated plurality of charge control parameters; and generating the development model for each color of the set includes generating a development model representative of measured toner characteristics as a function of the associated development parameters.

4. The invention of claim 1 wherein measuring the toner characteristic includes measuring toner density.

5. The invention of claim 4 wherein measuring toner density includes measuring optical density.

6. The invention of claim 1 wherein the system includes a grid responsive to a grid voltage for charging the photoconductor, and:

charging a test patch on the photoconductor includes charging a test patch on the photoconductor as a function of a known grid voltage; and generating a charge model includes generating a charge model representative of the measured charge characteristic as a function of associated grid voltage.

7. The invention of claim 1 wherein: measuring the charge characteristic includes measuring a charged photoconductor voltage at the first color test patch; and generating the charge model includes generating a charge model representative of charged photoconductor voltage as a function of the associated charge control parameter.

8. The invention of claim 7 wherein:

measuring the charge characteristic further includes a measuring a discharged photoconductor voltage at the first color test patch after exposing the photoconductor; and generating the charge model includes generating a charge model representative of a contrast voltage, the difference between the charged and discharged photoconductor voltages, as a function of the associated charge control parameter.

9. The invention of claim 1 wherein the system includes a development station responsive to a development voltage, and:

toning the photoconductor includes toning the photoconductor as a function of a known development voltage; and generating the development model includes generating a development model representative of the measured toner characteristic as a function of the associated development voltage.

10. The invention of claim 1 wherein the system is an electrophotographic system.

11. In an electrophotographic system of the type for printing a color image during a multiple imaging cycle printing run from image information representative of half-tone color patterns for each of a set of colors by sequentially, during an imaging cycle for each color of the set, charging a photoconductor as a function of a charge model representative of measured photoconductor charge characteristics as a function of a charge control parameter, exposing the photoconductor as a function of the color pattern information, and toning the exposed photoconductor as a function of a development model representative of measured developed toner characteristics as a function of a development parameter; wherein the improvement comprises a calibration procedure for generating the charge and development models for each color of the set during one printing run, including:

i) charging a test patch on the photoconductor as a function of a known charge control parameter;

ii) exposing the test patch on the photoconductor;

iii) measuring charge characteristics of the photoconductor at the test patch;

iv) toning the test patch of the photoconductor with a first color toner as a function of a known development parameter;

v) measuring the characteristic of the first color toner deposited on the first test patch;

vi) repeating steps i–v for each color of the set during one printing run;

vii) generating a charge model of the photoconductor for each color of the set; and viii) generating a developer model for each color of the set.

12. The calibration procedure of claim 11, wherein:

charging the photoconductor for each color of the set includes charging a plurality of test patches on the photoconductor with a range of different known charge control parameters;

measuring the charge characteristics for each color of the set includes measuring the charge characteristics of the photoconductor at each of the test patches;

toning the test patch for each color of the set includes toning each of the test patches with the first color toner as a function of one or more known development parameters;

measuring toner characteristic for each color of the set includes measuring the characteristic of the toner deposited on each of the test patches;

generating the charge model for each color of the set includes generating a charge model representative of measured charge characteristics as a function of the associated charge control parameters; and generating the development model for each color of the set includes generating a development model representative of measured toner characteristic as a function of the associated development parameters.

13. The calibration procedure of claim 12 wherein measuring the tone characteristic includes measuring a toner color characteristic.

14. The calibration procedure of claim 13 wherein measuring the toner color characteristic includes measuring toner density.

15. The calibration procedure of claim 12 wherein:

charging the test patches on the photoconductor includes charging the test patches as a function of known grid voltages; and generating the charge models includes generating charge models representative of the measured charge characteristic as a function of the associated grid voltage.

16. The calibration procedure of claim 12 wherein:

measuring the charge characteristics includes measuring charged photoconductor voltages; and generating the charge models includes generating charge models representative of charged photoconductor voltages as a function of the associated charge control parameters.

17. The calibration procedure of claim 16 wherein:

measuring the charge characteristics further includes measuring discharged photoconductor voltages; and generating the charge models includes generating charge models representative of contrast voltages, the differences between associated charged and discharged photoconductor voltages, as a function of associated charge control parameters.

18. The calibration procedure of claim 12 wherein:

toning the photoconductor includes toning the photoconductor as a function of known development voltages; and generating the development models includes generating development models representative of measured toner characteristics as a function of the associated development voltages.

19. In an electrophotographic proofing system of the type for generating color proofs during multiple imaging cycle proofing runs from image information representative of half-tone color patterns for each of a set of colors by sequentially, during an imaging cycle for each color of the set, charging a photoconductor as a function of charge model representative of a measured photoconductor a charge characteristic as a function of a charging grid voltage, modulating a laser as a function of the color pattern information to expose the photoconductor, and toning the exposed photoconductor as a function of a development model representative of measured developed toner color characteristics as a function of developing station development voltages; a calibration procedure for generating charge and development models for each color of the set during one proofing run, and capable of supporting a range of operator selectable color characteristics, including:

i) charging a plurality of first color test patches on the photoconductor, each with a different known grid voltage from a range of grid voltages;

ii) exposing the first color test patches on the photoconductor;

iii) measuring the charge characteristics of the photoconductor at the first color test patches;

iv) toning the first color test patches as a function of known development voltages;

v) measuring the color characteristics of the toner at the first color test patches;

vi) repeating steps i–v for each remaining color of the set during one proofing run vii) generating a charge model, for each color of the set, representative of the measured charge characteristics as a function of the associated grid voltages; and viii) generating a development model, for each color of the set, representative of the measured color characteristics as a function of the associated development voltages.

20. The calibration procedure of claim 19 wherein measuring the toner color characteristics includes measuring toner density.

21. The calibration procedure of claim 19 wherein:

measuring the charge characteristics includes measuring charged photoconductor voltages; and generating the charge models includes generating charge models representative of charged photoconductor voltages as a function of the associated grid voltages.

22. The calibration procedure of claim 21 wherein:

measuring charge characteristics further includes measuring discharged photoconductor voltages; and generating the charge models includes generating charge models representative of contrast voltages, the differences between associated charged and discharged photoconductor voltages, as a function of the associated charge control parameters.

23. In an electrophotographic system for printing an image from image information during a printing run including an imaging cycle by charging a photoconductor during the imaging cycle as a function of a charge model representative of a measured photoconductor charge characteristic as a function of a charge control parameter, exposing the photoconductor as a function of the image information during the imaging cycle, and toning the exposed photoconductor during the imaging cycle as a function of a development model representative of a measured developed toner characteristic as a function of a development parameter; the improvement comprising a calibration procedure for generating the charge and development models during one system printing run, including:

i) charging a first color test patch on the photoconductor as a function of a known charge control parameter;

ii) exposing the first color test patch on the photoconductor;

iii) measuring a charge characteristic of the photoconductor at the first color test patch;

iv) toning the photoconductor at the first color test patch with a first color toner as a function of a known development parameter;

v) measuring the characteristic of the first color toner deposited on the first color test patch;

vi) generating a charge model for the photoconductor; and vii) generating a development model for the first color toner, wherein the electrophotographic system prints multicolored images from information representative of a set of half-tone color patterns during multiple imaging cycle printing runs by sequentially, during an imaging cycle for each color of the set, charging, exposing and toning the photoconductor, and the calibration procedure further includes generating charge and development models for each color of the set during the printing run by:

viii) charging a second color test patch on the photoconductor as a function of a known charge control parameter;

ix) exposing the second color test patch on the photoconductor;

x) measuring the charge characteristic of the photoconductor at the second color test patch;

xi) toning the photoconductor at the second color test patch with a second color toner as a function of a known development parameter;

xii) measuring the characteristic of the second color toner deposited on the second color test patch;

xiii) repeating steps viii–xii for each remaining color of the set during the printing run;

xiv) generating a charge model for each color of the set; and xv) generating a development model for each color of the set.

24. The invention of claim 23, wherein:

charging the photoconductor for each color of the set includes charging a plurality of test patches on the photoconductor with a range of different known charge control parameters;

measuring the charge characteristic for each color of the set includes measuring the charge characteristic of the photoconductor at each of the test patches;

toning the test patch for each color of the set includes toning each of the test patches with the toner as a function of known development parameters;

measuring the toner characteristic for each color of the set includes measuring the characteristic of the toner deposited on each of the test patches;

generating the charge model for each color of the set includes generating a charge model representative of measured charge characteristics as a function of the associated plurality of charge control parameters; and generating the development model for each color of the set includes generating a development model representative of measured toner characteristics as a function of the associated development parameters.

* * * * *